US006628193B2

(12) United States Patent
Doi et al.

(10) Patent No.: US 6,628,193 B2
(45) Date of Patent: Sep. 30, 2003

(54) VARIABLE RESISTOR

(75) Inventors: Takeshi Doi, Fukui-ken (JP); Yukinori Ueda, Fukui-ken (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/887,677

(22) Filed: Jun. 20, 2001

(65) Prior Publication Data

US 2002/0070843 A1 Jun. 13, 2002

Related U.S. Application Data

(63) Continuation of application No. 09/605,857, filed on Jun. 29, 2000.

(30) Foreign Application Priority Data

Jun. 30, 1999 (JP) ..... 11-186351

(51) Int. Cl.[7] ..... H01C 10/32
(52) U.S. Cl. ..... 338/162; 338/174; 338/175
(58) Field of Search ..... 338/160, 162, 338/118, 174, 175

(56) References Cited

U.S. PATENT DOCUMENTS

| | | | | |
|---|---|---|---|---|
| 3,377,606 A | | 4/1968 | Ferrell | |
| 3,537,056 A | * | 10/1970 | Van Benthyoysen | |
| 3,683,308 A | * | 8/1972 | Hamill | 338/162 |
| 4,429,297 A | | 1/1984 | Nakatsu | |
| 4,636,768 A | * | 1/1987 | Hagen | 338/312 |
| 4,774,490 A | | 9/1988 | Azuchi | |
| 4,785,278 A | | 11/1988 | Nishizawa et al. | |
| 4,839,960 A | | 6/1989 | Yokoi et al. | |
| 4,994,782 A | | 2/1991 | Watanabe et al. | |
| 5,053,741 A | | 10/1991 | Ueda | |
| 5,293,525 A | | 3/1994 | Yoshimura | |
| 5,500,634 A | | 3/1996 | Ueda | |
| 5,847,640 A | | 12/1998 | Fukaya et al. | |
| 5,982,272 A | | 11/1999 | Masuda | |
| 6,037,855 A | | 3/2000 | Honma | |

FOREIGN PATENT DOCUMENTS

| | | |
|---|---|---|
| JP | 58-60905 | 4/1983 |
| JP | 2-63102 | 3/1990 |
| JP | 2-101705 | 4/1990 |
| JP | 3-2602 | 1/1991 |
| JP | 7-86001 | 3/1995 |
| JP | 9-223608 | 8/1997 |
| JP | 10-270220 | 10/1998 |

* cited by examiner

*Primary Examiner*—Karl D. Easthom
(74) *Attorney, Agent, or Firm*—Burns, Doane, Swecker & Mathis, LLP

(57) ABSTRACT

A thin-thickness variable resistor is provided, which is capable of stabilizing electrical connection between metallic terminals and a resistor by increasing the holding strength for a second terminal by a substrate while preventing the bending strain during the bending work from spreading to a conductive portion conductive to the resistor. A variable resistor comprises a substrate, metallic terminals formed in the substrate by insert-molding, and a slider sliding on a resistor formed on the substrate, wherein the slider is rotatably attached by crimping an eyelet formed in a first metallic terminal. External-connecting portions of the metallic terminals are extended from the bottom portion of the substrate to be bent upwardly along sides of the substrate. Anchor portions to be embedded into the substrate are unitarily formed in the vicinity of the conductive portions of the second metallic terminals conductive to the resistor and between the conductive portions of the second metallic terminals and the external connection portions thereof.

5 Claims, 4 Drawing Sheets

VARIABLE RESISTOR

This application is a continuation of application Ser. No. 09/605,857, filed on Jun. 29, 2000.

BACKGROUND OF THE INVENTION

1. Field of the Invention

The present invention relates to small- and thin-sized variable resistors, and in particular relates to a holding structure for metallic terminals by a substrate.

2. Description of the Related Art

As disclosed in Japanese Unexamined Patent Application Publication No. 7-86001, there is known a conventional variable resistor wherein a first metallic terminal having an eyelet on a substrate is formed by insert-molding while a second metallic terminal is formed by insert-molding; a substantial arc resistor conducting the second metallic terminal is formed on the top surface of the substrate; then a slider including a drawn portion having a hole formed in the center thereof is fitted into the eyelet of the first metallic terminal and attached to the substrate by crimping the eyelet outwardly. The slider is unitarily formed of a contact arm portion sliding on the resistor and an adjusting portion to be rotationally operated with a tool.

The structure of the variable resistor described above is that external-connecting portions of the first and second metallic terminals are extended from the center portions of the substrate side walls in the thickness direction to be bent toward the bottom surface of the substrate. Thereby, the product can be reduced in size, and also enabling discrimination of the product when it is soldered to a printed board to be readily performed.

In order to achieve miniaturizing and reduction in thickness of such a variable resistor, there are methods of reduction in thickness of the substrate disposed in both sides of the insert-molded first and second metallic terminals; and of elimination of the substrate located in the bottom surface side lower than the terminal. A variable resistor made by the latter method is disclosed in Japanese Unexamined Patent Application Publication No. 9-223608. In this case, the external-connecting portions of the first and second metallic terminals are extended from the bottom surface of the substrate to be bent upwardly along side faces of the substrate.

Although miniaturization and reduction in the thickness of the variable resistor can be achieved when any of the methods described above is used, the holding strength for metallic terminals by the substrate decreases. Also, when the external-connecting portion of the metallic terminal is subjected to bending work, the bending stress is concentrated in the substrate portion supporting the external-connecting portion. When the thickness of the substrate is reduced as described above, rattles may be likely generated in the metallic terminal because of the reduced holding strength for the terminal. In particular, one end of the second metallic terminal is extended to be exposed to the substrate top face; the exposed portion is electrically connected to the resistor formed on the top face of the substrate; when this metallic terminal rattles, electrical connection to the resistor becomes unstable, resulting in deterioration of characteristics.

SUMMARY OF THE INVENTION

Accordingly, it is an object of the present invention to provide a thin-thickness variable resistor capable of stabilizing electrical connection between the metallic terminals and the resistor by increasing the holding strength for the second terminal by the substrate while preventing the bending strain of the terminal during the bending work from spreading to the conductive portion conductive to the resistor.

In order to achieve the above-mentioned object in accordance with a first aspect of the present invention, there is provided a variable resistor comprising: a substrate comprising a first metallic terminal formed in the substrate by insert-molding; a substantially arc-shaped resistor formed on the top surface of the substrate; and a second metallic terminal formed in the substrate by insert-molding and having a conductive portion conducted to the resistor; and a slider connected to the first metallic terminal and comprising a contact arm portion sliding on the resistor and an adjusting portion to be rotationally operated with a tool, wherein the slider is rotatably attached to the substrate, and wherein external-connecting portions of the first and second metallic terminals are extended from the substrate; anchor portions to be embedded into the substrate are integrally formed in the vicinity of the conductive portion of the second metallic terminal, and the anchor portions are integrally formed between the conductive portion of the second metallic terminal and the external connection portion thereof.

With these features, by unitarily forming anchor portions to be embedded into the substrate in the vicinity of the conductive portion of the second metallic terminal, and between the conductive portion of the second metallic terminal and the external connection portion thereof, the holding strength for the second metallic terminal by the substrate can be increased. In other words, at the portion where the terminal should not move as the function of the member and in the vicinity of the point to which an external stress is applied, the holding strength by which the substrate holds the second metallic terminal firmly can be increased to stabilize the electrical connection between the conductive portion of the second metallic terminal and the resistor, and avoid that the metallic terminal is disconnected inadvertently.

Preferably, in the variable resistor, the external-connecting portions of the first and second metallic terminals are bent along sides of the substrate.

In this case, since the anchor portion also has the effect of restraining the strain during the bending work of the external-connecting portion from spreading to the conductive portion, the electrical connection between the second metallic terminal and the resistor can be always stabilized.

Also, when the variable resistor is soldered to a printed board, since fillet is formed between the external-connecting portion and the printed board by bending the external-connecting portion of the metallic terminal along sides of the substrate, whether the soldering is sufficient or not can be easily judged by appearance.

In accordance with a second aspect of the present invention, there is provided a variable resistor comprising: a substrate comprising a first metallic terminal formed in the substrate by insert-molding and having an eyelet in the center thereof; a substantially arc-shaped resistor formed on the top surface of the substrate concentrically with the eyelet; and a second metallic terminal formed in the substrate by insert-molding and having a conductive portion conducting the resistor; and a slider comprising a drawn portion having a hole in the center thereof; a contact arm portion disposed in the periphery of the drawn portion and sliding on the resistor; and an adjusting portion to be rotationally operated with a tool, wherein the hole of the drawn portion is fit into the eyelet of the first metallic terminal, and the slider is rotatably attached to the substrate by crimping the eyelet to be spread outwardly, and wherein external-connecting portions of the first and second metallic terminals are extended from the bottom portion of said substrate; anchor portions to be embedded into said substrate are integrally formed in the vicinity of the conductive portion of the second metallic terminal, and the anchor portions are integrally formed between the conductive portion of the second metallic terminal and the external connection portion thereof.

By extending the external-connecting portions of the first and second metallic terminals from the bottom portion of the substrate in such a manner, the thickness of the substrate can be reduced to be smaller compared with that when extending them from the center portion in the thickness direction of the substrate. That is, the overall thickness of the variable resistor can be reduced to be smaller.

Furthermore, in the variable resistor according to the present invention, the external-connecting portions of the first and second metallic terminals may be bent upwardly along sides of the substrate.

In this cases spreading of the bending stress to the conductive portions during the bending work of the external-connecting portion is restrained by the anchor portions. Also, by bending the external-connecting portion of the metallic terminal upwardly from the bottom portion of the substrate along sides of the substrate, the discrimination of the soldering can be readily performed.

The anchor portions are available in various shapes. For example, there is a method to provide a hole or a raised piece by cutting the midway part of the metallic terminal; however, the anchor portion may be a projecting piece bent at an end of the anchor portion. In this case, the anchor portion can be simply formed and takes the secure anchor effect. That is, the second metallic terminal is generally formed by punching a planar metallic plate to have a predetermined shape by a press while being bent; when the anchor portion is the projecting piece having the bent end as described above, it has only the anchor effect without damaging the strength of the metallic terminal while it can be readily formed by an ordinary press.

DESCRIPTION OF THE PREFERRED EMBODIMENTS

FIGS. 1 to 9 show a variable resistor according to an embodiment of the present invention.

The variable resistor is formed of a substrate 1, in which fixed-side metallic terminals 2 and 3 and a variable-side terminal 4 are unitarily insert-molded, and a slider 6 attached to the variable-side terminal 4 by crimping.

The substrate 1 is made of a heat-resistant thermoplastic resin or a thermosetting resin in order to stand heat of soldering and enable to undergo stable operations in a high-temperature atmosphere. For example, a liquid crystalline polymer (LCP) resin, denatured 6T nylon, a polyphenylene sulfide (PPS) resin, a polyester resin, an epoxy resin, a diallyl phthalate resin, and so forth are used.

Figure 1:
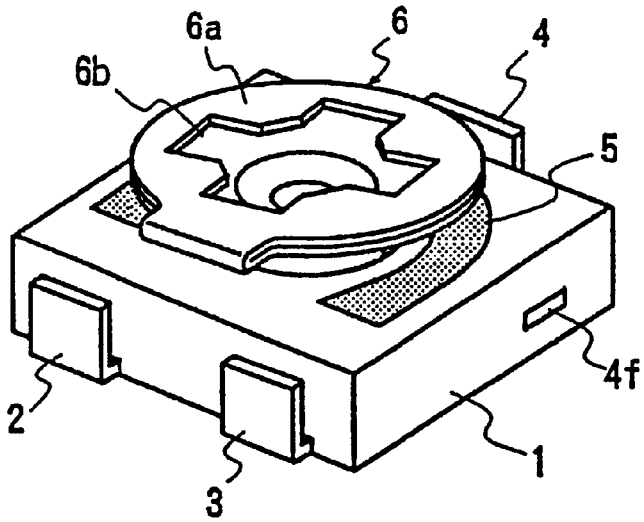
FIG. 1 is a perspective view showing an assembled state of a variable resistor according to an embodiment of the present invention.
Figure 2:
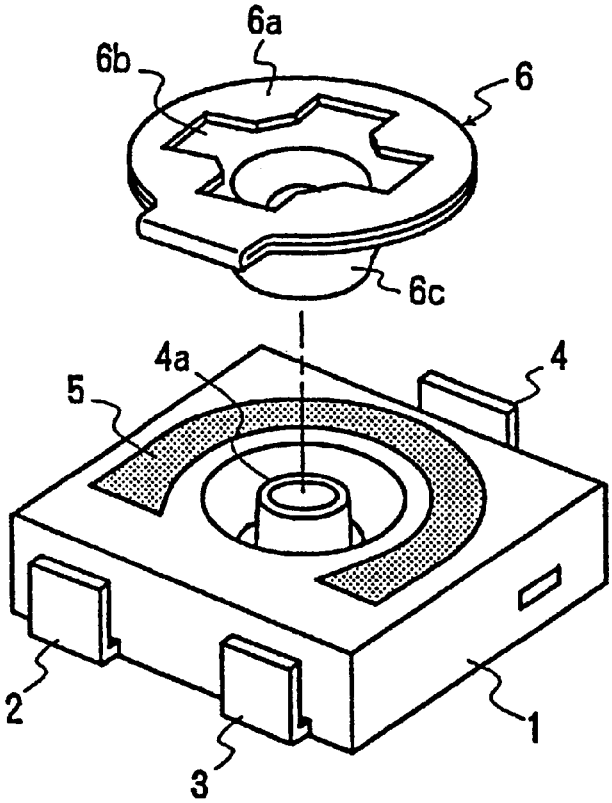
FIG. 2 is an assembly view of the variable resistor shown in FIG. 1.
Figure 3:
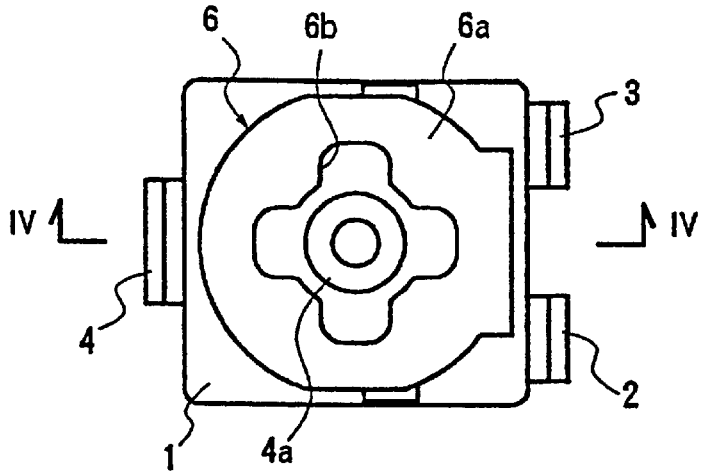
FIG. 3 is a plan view of the variable resistor shown in FIG. 1.
Figure 4:
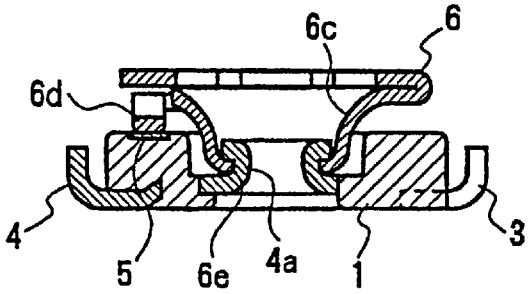
FIG. 4 is a sectional view at the line IV—IV of FIG. 3.
Figure 5:
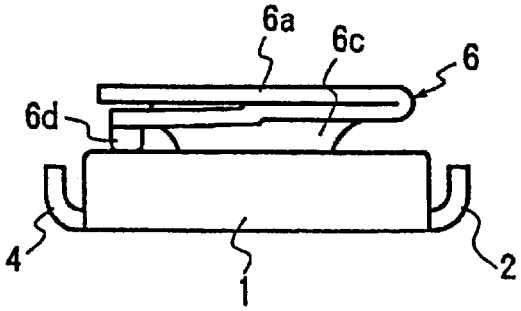
FIG. 5 is a side view of the variable resistor shown in FIG. 1.
Figure 6:
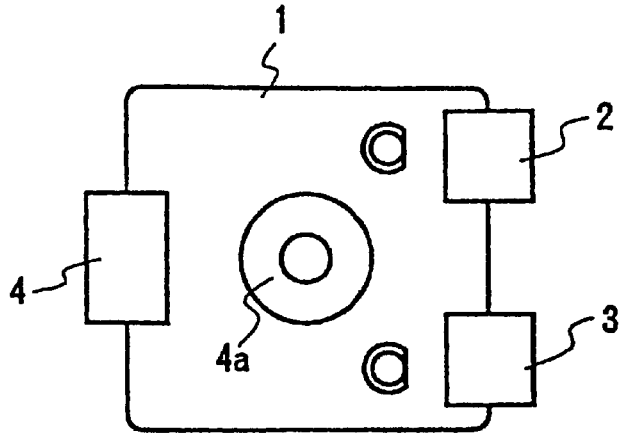
FIG. 6 is a bottom plan view of the variable resistor shown in FIG. 1.
Figure 7:
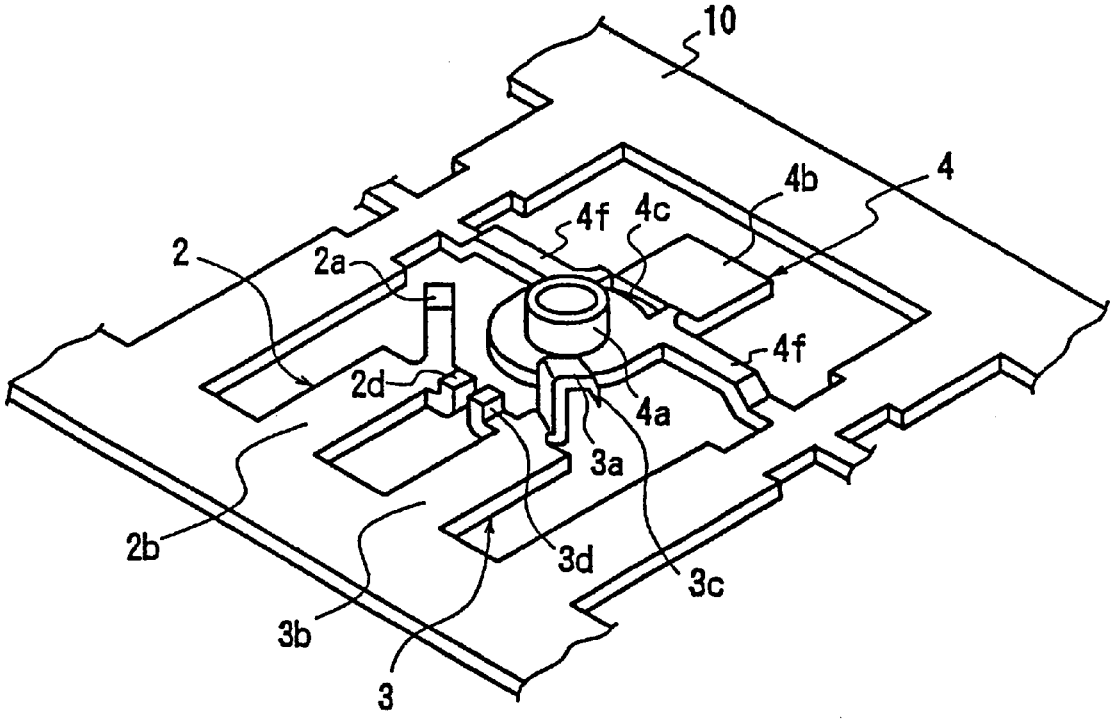
FIG. 7 is a perspective view of a lead frame in which fixed-side and variable-side metallic terminals used for the variable resistor shown in FIG. 1 are unitarily punched.

On the top face of the substrate 1, conductive portions 2*a* and 3*a* of the fixed-side terminals 2 and 3 are exposed. External-connecting portions 2*b*, 3*b*, and 4*b* that are soldering portions of the fixed-side terminals 2 and 3 and the variable-side terminal 4 to a printed board extend from the bottom face of the substrate 1 to be bent upwardly along sides of the substrate 1. As shown in FIGS. 7 and 9, first anchor portions 2*c* and 3*c* bent downwardly are formed in the fixed-side terminals 2 and 3 toward distal ends from the conductive portions 2*a* and 3*a* thereof. Second anchor portions 2*d* and 3*d* bent upwardly are formed in the middle position between the conductive portions 2*a* and 3*a* and the external-connecting portions 2*b* and 3*b*. These anchor portions 2*c*, 3*c*, 2*d*, and 3*d* are formed of projecting pieces so as to be embedded into the substrate 1 (see FIG. 8). On the top surface of the substrate 1, a resistor 5 made of carbon, etc., is put by baking to be substantially arc-shaped so as to cover the conductive portions 2*a* and 3*a* of the fixed-side terminals 2 and 3. Thereby, the fixed-side terminals 2 and 3 and the resistor 5 are electrically conductive together. At one end of the variable-side terminal 4, an eyelet 4*a* is unitarily formed to be exposed from a central hole 1*a* of the substrate 1. Between the eyelet 4*a* of the variable-side terminal 4 and the external-connecting portion 4*b*, an escape hole 4*c* for restraining the strain during the bending work of the external-connecting portion 4*b* from spreading is formed.

In addition, the fixed-side terminals 2 and 3 and the variable-side terminal 4 are formed of a thin plate made of an excellent conductive material such as a copper alloy, stainless steel. In order to promote solderability, surface treatment may be performed at least on the external-connecting portions 2*b*, 3*b*, and 4*b* by plating of a noble metal such as gold, silver, soldering, and tinning.

The slider 6 is formed of a thin plate made of a metal having excellent conductivity and springing characteristics such as a copper alloy, stainless steel, or a noble metal alloy. The slider 6 comprises an annular top face portion 6*a* and a cup-shaped drawn portion 6*c* folded from the outer periphery of the top face portion 6*a* toward the bottom face. In the top face portion 6*a*, a cross-shaped engaging hole (adjusting portion) 6*b* to be operated with a tool such as a screwdriver is formed. A half-arc-shaped contact arm portion 6*d* is formed in the outer periphery opposite to the folded portion of the drawn portion 6*c*. The contact arm portion 6*d* elastically and slidably touches the surface of the resistor 5. In the center of the drawn portion 6*c*, a fitting hole 6*e* for fitting the eyelet 4*a* of the variable-side terminal 4 is formed. The slider 6 is rotatably attached to the substrate 1 by crimping the eyelet 4*a* to open it outwardly after fitting the fitting hole 6*e* to the eyelet 4*a* of the variable-side terminal 4.

FIG. 7 shows a lead frame 10 in that the fixed-side terminals 2 and 3 and the variable-side terminal 4 are formed by press bending of one metallic plate.

The fixed-side terminals 2 and 3 are connected to the lead frame 10 via the external-connecting portions 2*b* and 3*b* while the variable-side terminal 4 is connected to the lead frame 10 via narrow supporting portions 4*f*. These supporting portions 4*f* are for holding the position of the variable-side terminal 4 during the insert-molding and will be removed by cutting when the product is completed.

Figure 8:
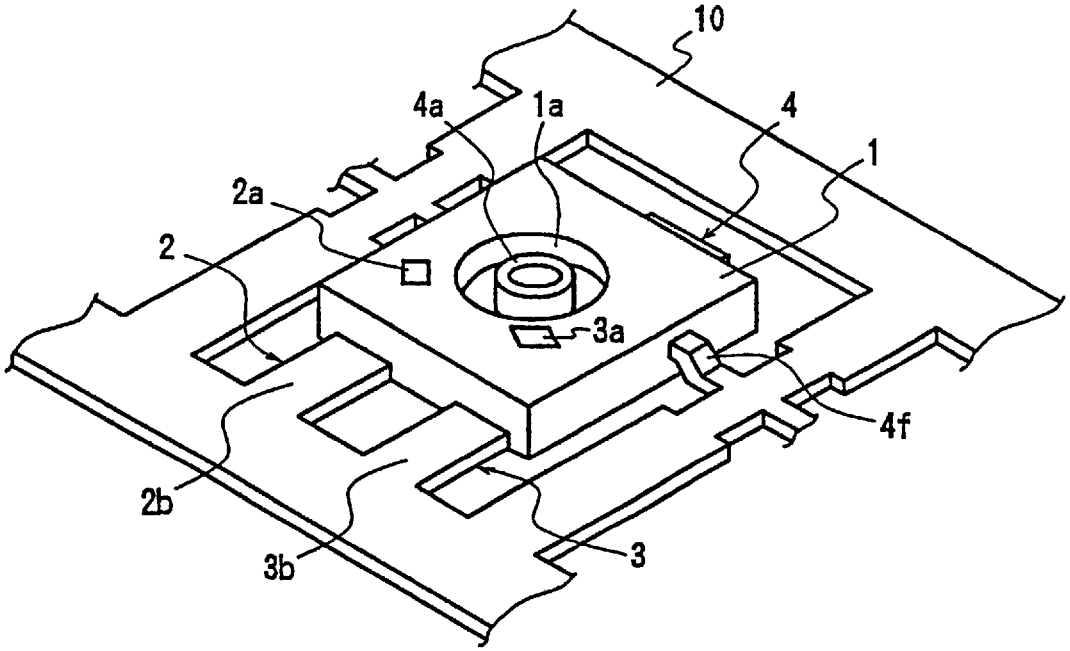
FIG. 8 is a perspective view of the lead frame shown in FIG. 7, in which a substrate is molded.
Figure 9:
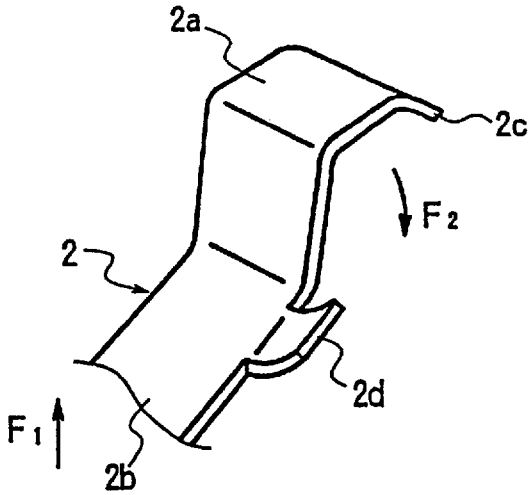
FIG. 9 is an enlarged partial perspective view of the fixed-side metallic terminal.

FIG. 8 shows a molded state of the substrate 1 to the lead frame 10.

As understood from the drawing, the eyelet 4*a* of the variable-side terminal 4 is exposed from the central hole 1*a* of the substrate 1 while the conductive portions 2*a* and 3*a* of the fixed-side terminals 2 and 3 are exposed to the top face of the substrate 1.

As shown in FIG. 8, the external-connecting portions 2*b*, 3*b*, and 4*b* of the fixed-side terminals 2 and 3 and the variable-side terminal 4 are upwardly bent along sides of the substrate 1 after cutting the external-connecting portions 2*b* and 3*b* and the supporting portions 4*f* off the lead frame 10 to that the substrate 1 is insert-molded. At this time, as shown in FIG. 9, great bending stresses "$F_1$" are applied to the roots of the external-connecting portions 2*b*, 3*b*, and 4*b* protruding from the substrate 1. Corresponding to the stress "$F_1$", forces "$F_2$" are downwardly applied to the conductive portions 2*a* and 3*a*. Since the anchor portions 2*c*, 3*c*, 2*d*, and 3*d* embedded into the substrate 1 are formed in the fixed-side terminals 2 and 3 correspondingly, these anchor portions 2*c*, 3*c*, 2*d*, and 3*d* dig into the substrate 1 so that rattles in the fixed-side terminals 2 and 3 due to the stress "$F_2$" are dissolved. Likewise, the bending strain generated in the external-connecting portions 2*b* and 3*b* are substantially reduced by the second anchor portions 2*d* and 3*d*, which in turn are furthermore reduced by the first anchor portion 2*c* and 3*c* to be almost negligible. Therefore, spreading of the bending stress to the conductive portions 2*a* and 3*a* is also restrained by the anchor portions 2*c*, 3*c*, 2*d*, and 3*d*. Consequently, rattles and strain in the conductive portions 2*a* and 3*a* of the fixed-side terminals 2 and 3 are dissolved, resulting in securing of excellent conduction between the conductive portions 2*a* and 3*a* and the resistor 5.

Also, when the external-connecting portion 4*b* of the variable-side terminal 4 is bent, it is possible that rattles are generated in the variable-side terminal 4 due to the bending stress. However, since the escape hole 4*c* is formed in the mid position of the variable-side terminal 4, spreading of the bending stress of the external-connecting portion 4*b* to the eyelet 4*a* is restrained by the escape hole 4*c* while the resin material of the substrate 1 enters the escape hole 4*c*. Accordingly, rattles cannot be generated in the eyelet 4*a* even when the external-connecting portion 4*b* is bent.

In the above-described embodiment, only one example of anchor portions is shown; however, the shape and the position of the anchor portion are not limited to the embodiment.

In the embodiment, the first anchor portions 2*c* and 3*c* are formed toward the end from the conductive portions 2*a* and 3*a* of the fixed-side terminals 2 and 3; however, they may be formed in the sides of the conductive portions 2*a* and 3*a*. In any case, it is effective when forming them in the vicinity of the conductive portions 2*a* and 3*a*.

In the embodiment, the external-connecting portions of the first and second metallic terminals are described that they are extended from the bottom of the substrate to be bent upwardly; however, as a conventional example disclosed in Japanese Unexamined Patent Application Publication No. 7-86001, it is also effective that the external-connecting portion of the metallic terminal is extended from the center portion in the thickness direction of the substrate to be bent toward the bottom surface of the substrate.

Furthermore, since the anchor portion of the metallic terminal according to the present invention is for increasing the holding strength of the metallic terminal, it is similarly effective even when the external-connecting portion of the metallic terminal is extended from the bottom of the substrate and is not bent upwardly as it is.

As understood from the description above, according to the first and the second aspect of the present invention, since the anchor portions to be embedded into the substrate are unitarily formed in the vicinity of the conductive portion of the second metallic terminal and between the conductive portion and the external-connection portion thereof, that is, in the portion where the terminal should not move as the function of the member and in the vicinity of the point to which an external stress is applied, the second metallic terminal is firmly held by the anchor portions. Also, the rattles generated during the bending work of the external-connecting portion of the second metallic terminal can be dissolved while the bending strain can be prevented from spreading to the conductive portion, so that electrical connection between the conductive portion of the second metallic terminal and the resistor is stabilized.

Also, when the external-connecting portions of the first and second metallic terminals are extended from the bottom portion of the substrate, the thickness of the substrate can be reduced to be smaller compared with that when being extended from the center portion in the thickness direction of the substrate.

When the external-connecting portion of the metallic terminal is bent from the center portion in the thickness direction of the substrate side-wall toward the bottom surface of the substrate or from the bottom surface of the substrate along the side of the substrate upwardly, during the soldering of the variable resistor to a printed board, fillet is formed between the external-connecting portion and the printed board, so that the variable resistor has the effect that the discrimination of the soldering can be readily performed.

What is claimed is:

1. A variable resistor comprising:

a substrate comprising a first metallic terminal formed in said substrate by insert-molding; a substantially arc-shaped resistor formed on the top surface of said substrate; and a second metallic terminal formed in said substrate by insert-molding and having a conductive portion in contact with the resistor, said conductive portion being exposed on the top surface of the substrate; and a slider connected to the first metallic terminal and comprising a contact arm portion sliding on the resistor and an adjusting portion to be rotationally operated with a tool, wherein said slider is rotatably attached to said substrate, and wherein external-connecting portions of the first and second metallic terminals are extended from said substrate;

one end of the conductive portion is bent downwardly to define a first anchor portion embedded into the substrate;

the other end of the conductive portion has an extending portion embedded into the substrate, said extending portion is integrally formed with the external connection portion and arranged between the other end of the conductive portion and the external connecting portion;

a second anchor portion branched from a side of the extending portion is projected upwardly and is embedded into the substrate.

2. A variable resistor according to claim 1, wherein the external-connecting portions of the first and second metallic terminals are bent along sides of said substrate.

3. A variable resistor according to claim 1, wherein said first anchor portion projects in a first direction and said second anchor portion projects in a second direction which is opposite to the first direction.

4. A variable resistor comprising:

a substrate comprising a first metallic terminal formed in said substrate by insert-molding and having an eyelet in a center thereof; a substantially arc-shaped resistor formed on a top surface of said substrate concentrically with the eyelet; and a second metallic terminal formed in said substrate by insert-molding and having a conductive portion in contact with the resistor, said conductive portion being exposed on the top surface of the substrate; and a slider comprising a drawn portion having a hole in a center thereof; a contact arm portion disposed in a periphery of the drawn portion and sliding on the resistor; and an adjusting portion to be rotationally operated with a tool, wherein the hole of the drawn portion is fit into the eyelet of the first metallic terminal, and said slider is rotatably attached to the substrate by crimping the eyelet to be spread outwardly, and wherein external-connecting portions of the first and second metallic terminals are extended from said substrate;

a second anchor portion branched from a side of the extending portion is projected upwardly and is embedded into the substrate.

5. A variable resistor according to claim 4, wherein the external-connecting portions of the first and second metallic terminals are bent upwardly along sides of said substrate.

* * * * *